US010356528B2

(12) United States Patent
Chabanne

(10) Patent No.: US 10,356,528 B2
(45) Date of Patent: Jul. 16, 2019

(54) ENHANCING THE REPRODUCTION OF MULTIPLE AUDIO CHANNELS

(71) Applicant: Dolby Laboratories Licensing Corporation, San Francisco, CA (US)

(72) Inventor: Christophe Chabanne, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 93 days.

(21) Appl. No.: 15/644,520

(22) Filed: Jul. 7, 2017

(65) Prior Publication Data

US 2017/0311081 A1 Oct. 26, 2017

Related U.S. Application Data

(63) Continuation of application No. 14/636,427, filed on Mar. 3, 2015, now Pat. No. 9,706,308, which is a continuation of application No. 13/061,553, filed as application No. PCT/US2009/055118 on Aug. 27, 2009, now Pat. No. 9,014,378.

(60) Provisional application No. 61/190,963, filed on Sep. 3, 2008.

(51) Int. Cl.
*H04R 5/04* (2006.01)
*H04S 3/00* (2006.01)

(52) U.S. Cl.
CPC ..... *H04R 5/04* (2013.01); *H04S 3/002* (2013.01)

(58) Field of Classification Search
CPC ..... H04R 5/04
USPC .... 381/17, 18, 300, 303, 304, 309, 386, 387
See application file for complete search history.

(56) References Cited

U.S. PATENT DOCUMENTS

| | | | | |
|---|---|---|---|---|
| 4,612,663 | A | 9/1986 | Holbrook | |
| 4,837,825 | A | 6/1989 | Shivers | |
| 4,932,059 | A | 6/1990 | Fosgate | |
| 5,172,415 | A | 12/1992 | Fosgate | |
| 5,263,087 | A | 11/1993 | Fosgate | |
| 5,708,718 | A | 1/1998 | Ambourn | |
| 5,748,746 | A | 5/1998 | Oaki | |
| 5,857,026 | A * | 1/1999 | Scheiber | H04S 3/00 381/18 |
| 6,487,296 | B1 | 11/2002 | Allen | |
| 6,760,448 | B1 | 7/2004 | Gundry | |

(Continued)

FOREIGN PATENT DOCUMENTS

| | | |
|---|---|---|
| CN | 101009952 | 8/2007 |
| EP | 0325175 | 7/1989 |

(Continued)

OTHER PUBLICATIONS

Audio Pulse Model 1 Owners Manual, relevant page "Using the Additional taps for 6-Channel or 8-Channel Operation". This undated publication is believed to have been published at least as early as 1977, which year of publication is sufficiently earlier than the effective U.S. filing date and any foreign priority date so that the particular month of publication is not in issue. (See MPEP 609.04a).

(Continued)

*Primary Examiner* — Yosef K Laekemariam

(57) ABSTRACT

This invention relates to the field of multichannel audio. More particularly, the invention relates to a method for the provision of audio channels suitable for application to loudspeakers located above conventional front loudspeakers.

20 Claims, 3 Drawing Sheets

(56) References Cited

U.S. PATENT DOCUMENTS

| | | | | |
|---|---|---|---|---|
| 6,961,433 | B2 | 11/2005 | Ishii | |
| 7,558,393 | B2 | 7/2009 | Miller, III | |
| 8,199,921 | B2 | 6/2012 | Katayama | |
| 2002/0047902 | A1* | 4/2002 | Thomas | H04N 17/004 348/180 |
| 2003/0007648 | A1 | 1/2003 | Currell | |
| 2004/0062401 | A1 | 4/2004 | Davis | |
| 2004/0247135 | A1 | 12/2004 | Dressler | |
| 2007/0140497 | A1* | 6/2007 | Moon | H04S 5/005 381/20 |
| 2007/0253583 | A1* | 11/2007 | Melanson | H04R 3/12 381/303 |
| 2007/0263890 | A1 | 11/2007 | Melanson | |
| 2008/0063211 | A1* | 3/2008 | Kusunoki | H04R 3/12 381/18 |
| 2008/0130905 | A1 | 6/2008 | Fincham | |
| 2008/0205675 | A1 | 8/2008 | Kutuzov | |
| 2009/0110204 | A1 | 4/2009 | Walsh | |

FOREIGN PATENT DOCUMENTS

| | | |
|---|---|---|
| JP | H05-191897 | 7/1993 |
| JP | 2007-081927 | 3/2007 |
| JP | 2007-300403 | 11/2007 |
| JP | 2008-186899 | 8/2008 |
| KR | 10-2007-0073536 | 7/2007 |
| RU | 2329548 | 7/2008 |
| TW | 569551 | 1/2004 |
| TW | 1313857 | 10/2006 |
| WO | 2005/101371 | 10/2005 |

OTHER PUBLICATIONS

Furness, Roger K., "Ambisonics—An Overview" AES 8th International Conference, pp. 181-190, May 1990.

Gerzon, Michael A. "Ambisonics in Multichannel Broadcasting and Video" Presented at the 74th Convention of the Audio Engineering Society, New York, Oct. 8-12, 1983, vol. 33, No. 11, Nov. 1985, pp. 859-871.

Jot, et al., "Spatial Enhancement of Audio Recordings" Proceedings of the International AES Conference May 23, 2003, pp. 1-11.

Miller, III, Robert E., "Transforming Ambiophonic + Ambisonic 3D Surround Sound to & from ITU 5.1/6.1" Audio Engineering Society Convention Paper 5799, Presented at the 114th Convention, Mar. 22-25, 2003 Amsterdam, Netherlands.

Plomp, et al., "Tonal Consonance and Critical Bandwidth" JASA, vol. 38, 1965, pp. 548-560, received Apr. 26, 1965.

* cited by examiner

ENHANCING THE REPRODUCTION OF MULTIPLE AUDIO CHANNELS

CROSS-REFERENCE TO RELATED APPLICATIONS

This application is a Continuation Application of U.S. patent application Ser. No. 14/636,427 filed 3 Mar. 2015, which in turn is a Continuation Application of U.S. patent application Ser. No. 13/061,553 filed 1 Mar. 2011, which claims priority to the US national phase of PCT application PCT/US2009/055118, filed Aug. 27, 2009, which claims priority to U.S. Patent Provisional Application No. 61/190,963, filed 3 Sep. 2008, hereby incorporated by reference in its entirety.

FIELD OF THE INVENTION

This invention relates to the field of multichannel audio. More particularly, the invention relates to a method for the provision of audio channels suitable for application to loudspeakers located above conventional front loudspeakers. The invention also relates to apparatus for performing the method and a computer program for performing the method.

SUMMARY OF THE INVENTION

In accordance with aspects of the invention, a method of enhancing the reproduction of multiple audio channels, the channels including channels intended for playback to the front of a listening area and channels intended for playback to the sides and/or rear of the listening area, comprises extracting out-of-phase sound information from a pair of the channels intended for playback to the sides or rear sides of the listening area, and applying the out-of-phase sound information to one or more loudspeakers located above loudspeakers playing back channels intended for playback to the front of the listening area.

The extracting may extract two sets of out-of-phase information and the applying may apply the first set of out-of-phase information to one or more left vertical height loudspeakers located above one or more left loudspeakers playing back a channel or channels intended for playback to the left front of the listening area and may apply the second set of out-of-phase information to one or more right vertical height loudspeakers located above one or more right loudspeakers playing back a channel or channels intended for playback to the right front of the listening area. According to a first alternative, the extracting may extract a single-channel monophonic audio signal comprising out-of-phase components in the pair of channels and divide the monophonic audio signal into two signals, a left vertical height signal and a right vertical height signal, for coupling, respectively, to the left vertical height and right vertical height loudspeakers. According to a second alternative, extracting may extract two audio signals, a left vertical height signal and a right vertical height signal, for coupling, respectively, to the left vertical height and right vertical height loudspeakers, each of which vertical height signals comprises out-of-phase components in the pair of channels, the left vertical height signal being weighted to the left side and/or left rear side channel in the pair of channels and the right vertical height signal being weighted to the right side and/or right rear side channel in the pair of channels.

The signals applied to the left vertical height and right vertical height loudspeakers preferably are in phase with each other in order to minimize out-of-phase signal cancellation at particular positions in the listening area.

According to the first of three alternatives, there is one pair of channels intended for playback to the sides and/or rear sides of the listening area, a left surround channel and a right surround channel. According to the second of the three alternatives, there is one pair of channels intended for playback to the sides and/or rear sides of the listening area, a left rear surround channel and a right rear surround channel. According to the third of the three alternatives, there are two pairs of channels intended for playback to the sides and/or rear sides of the listening area, a pair of side surround channels and a pair of rear surround channels, and wherein the pair of side surround channels are the left surround and right surround channels and the pair of rear surround channels are the left rear surround and right rear surround channels.

The extracting may extract the out-of-phase sound information using a passive matrix. The pair of channels from which the out-of-phase sound information is extracted may be designated Ls and Rs and the extracted out-of-phase sound information may be designated Lvh and Rvh, such that the relationships among Lvh, Rvh, Ls and Rs may be characterized by $$Lvh=[(0.871*Ls)-(0.49*Rs)], \text{ and}$$

$$Rvh=[(-0.49*Ls)+(0.871*Rs)].$$

Alternatively, the extracting may extract the out-of-phase sound information using an active matrix.

The multiple audio channels may be derived from a pair of audio source signals. The pair of audio signals may be a stereophonic pair of audio signals into which directional information is encoded. Alternatively, the multiple audio channels may be derived from more than two audio source signals comprising independent signals representing respective channels intended for playback to the front of the listening area and to the sides and/or rear of the listening area. A pair of independent signals representing respective channels intended for playback to the sides and/or rear of the listening area may be encoded with out-of-phase vertical height information.

None of FIGS. 1-6 is to scale.

FIGS. 7-10 show examples of various ways according to aspects of the present invention in which signals for applying to loudspeakers at the Lvh and Rvh loudspeaker locations may be obtained.

DESCRIPTION OF THE INVENTION

Figure 1:
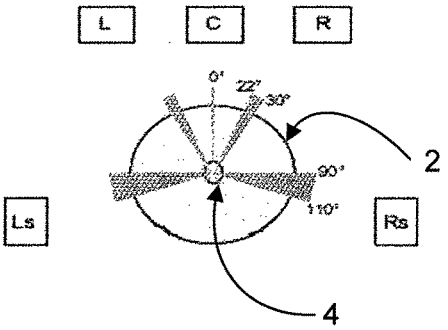
FIG. 1 is a schematic plan view of an environment showing idealized loudspeaker locations for reproducing left (L), center (C), and right (R) audio channels intended for playback to the front of a listening area and left surround (Ls) and right surround (Rs) audio channels intended for playback to the sides of a listening area.

FIG. 1 is a schematic plan view of an environment showing idealized loudspeaker locations for reproducing left (L), center (C), and right (R) audio channels intended for playback to the front of a listening area and left surround (Ls) and right surround (Rs) audio channels intended for playback to the sides of a listening area. Such arrangements typically also include an "LFE" (low frequency effects) loudspeaker (such as a subwoofer) and are often referred to as "5.1" channel playback arrangements (five main channels plus the LFE channel). For simplicity in presentation, no further reference will be made to the LFE channel, it not being necessary to the exposition or understanding of the invention.

A notional listening area 2 having a center 4 is shown among the five idealized loudspeaker locations. Setting the center loudspeaker location at 0 degrees with respect to the listening area center, the other loudspeaker locations may have a range of relative angular locations as shown—the right loudspeaker location from 22 to 30 degrees (the left being the mirror image location range) and the right surround loudspeaker location from 90 to 110 degrees (the left surround being the mirror image location range).

Figure 2:
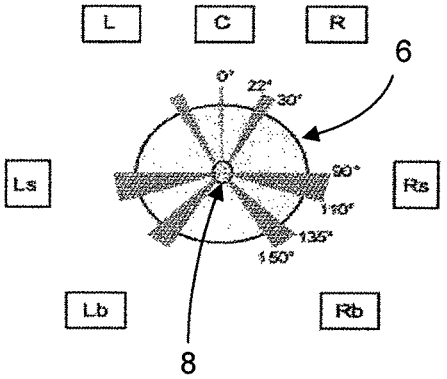
FIG. 2 is a schematic plan view of an environment showing idealized loudspeaker locations for reproducing left (L), center (C), and right (R) audio channels intended for playback to the front of a listening area and left surround (Ls). right surround (Rs), left rear surround (Lrs) and right rear surround (Rrs) audio channels intended for playback to the sides and rear sides of a listening area.

FIG. 2 is a schematic plan view of an environment showing idealized loudspeaker locations for reproducing left (L), center (C), and right (R) audio channels intended for playback to the front of a listening area and left surround (Ls), right surround (Rs), left rear surround (Lrs) and right rear surround (Rrs) audio channels intended for playback to the sides and rear sides of a listening area. Such arrangements typically are often referred to as "7.1" channel playback arrangements (seven main channels plus an LFE channel).

A notional listening area 6 having a center 8 is shown among the seven idealized loudspeaker locations. Setting the center loudspeaker location at 0 degrees with respect to the listening area center, the other loudspeaker locations may have a range of relative angular locations as shown—the right loudspeaker location from 22 to 30 degrees (the left being the mirror image location range), the right surround loudspeaker location from 90 to 110 degrees (the left surround being the mirror image location range), and the right rear surround loudspeaker location (the left rear surround being the mirror image location range).

Figure 3:
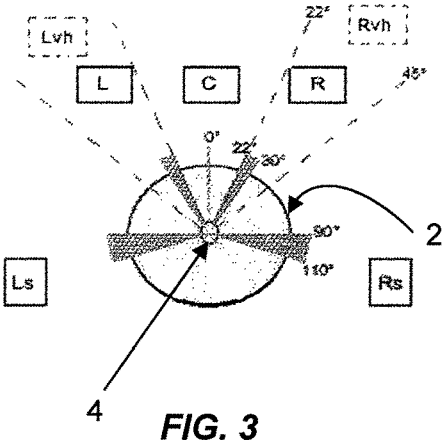
FIG. 3 shows the FIG. 1 example to which vertical height loudspeaker locations in accordance with aspects of the present invention have been added.

FIG. 3 shows the FIG. 1 example to which vertical height loudspeaker locations in accordance with aspects of the present invention have been added. A right vertical height (Rvh) loudspeaker location is shown in dashed lines (to indicate that it is above the right (R) loudspeaker location) within an angle range of 22 to 45 degrees with respect to the listening area center 4. A left vertical height (Lvh) loudspeaker location is shown in dashed lines (to indicate that it is above the left (L) loudspeaker location) within a mirror image of the angle range of 22 to 45 degrees with respect to the listening area center 4.

Figure 4:
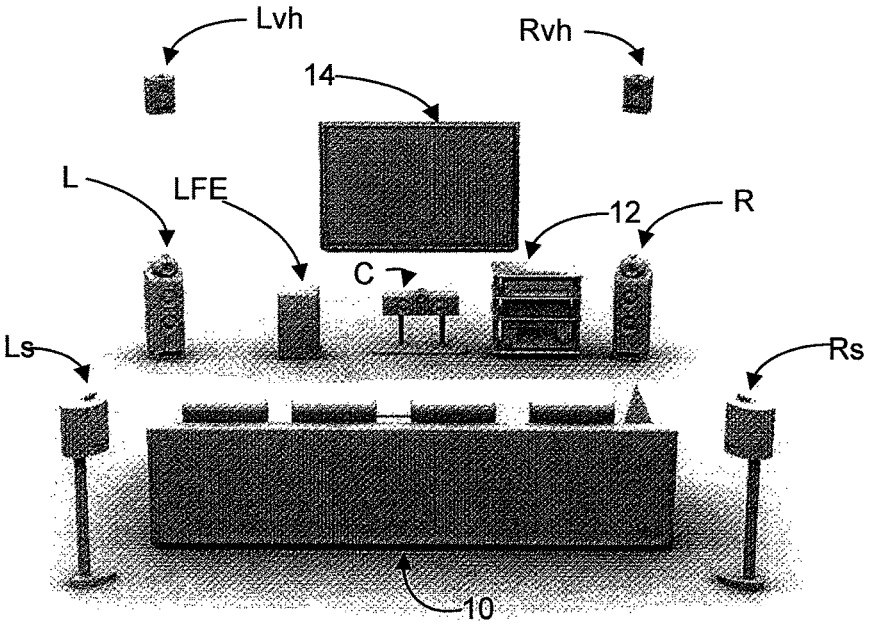
FIG. 4 shows the FIG. 3 example in a small room environment.

FIG. 4 shows the FIG. 3 example in a small room environment. A sofa 10 is located in the listening area 2. Loudspeakers are located at the L, LFE, C, R, Lvh, Rvh, Ls and Rs loudspeaker locations. Equipment associated with the multiple audio channels are shown schematically at 12. A video screen 13 is located above the center loudspeaker location.

It will be noted that the Lvh and Rvh loudspeaker locations are above the loudspeaker locations of the front audio channels. For example, it has been found that suitable Lvh and Rvh loudspeaker locations are at least one meter above the L and R loudspeaker locations and as high as possible. Also, although it has been found that the Lvh and Rvh loudspeaker locations may be at an angle wider than the L and R loudspeaker locations (up to 45 degrees rather than 30 degrees, for example), the Lvh and Rvh loudspeaker locations preferably are substantially directly above the L and R loudspeaker locations. It will also be noted that the Lvh and Rvh loudspeaker locations are above the Ls and Rs loudspeaker locations.

Figure 5:
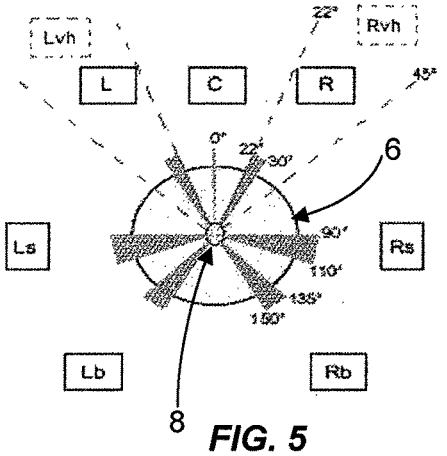
FIG. 5 shows the FIG. 1 example to which vertical height loudspeaker locations in accordance with aspects of the present invention have been added.

FIG. 5 shows the FIG. 1 example to which vertical height loudspeaker locations in accordance with aspects of the present invention have been added. A right vertical height (Rvh) loudspeaker location is shown in dashed lines (to indicate that it is above the right (R) loudspeaker location) within an angle range of 22 to 45 degrees with respect to the listening area center 4. A left vertical height (Lvh) loudspeaker location is shown in dashed lines (to indicate that it is above the left (L) loudspeaker location) within a mirror image of the angle range of 22 to 45 degrees with respect to the listening area center 8.

Figure 6:
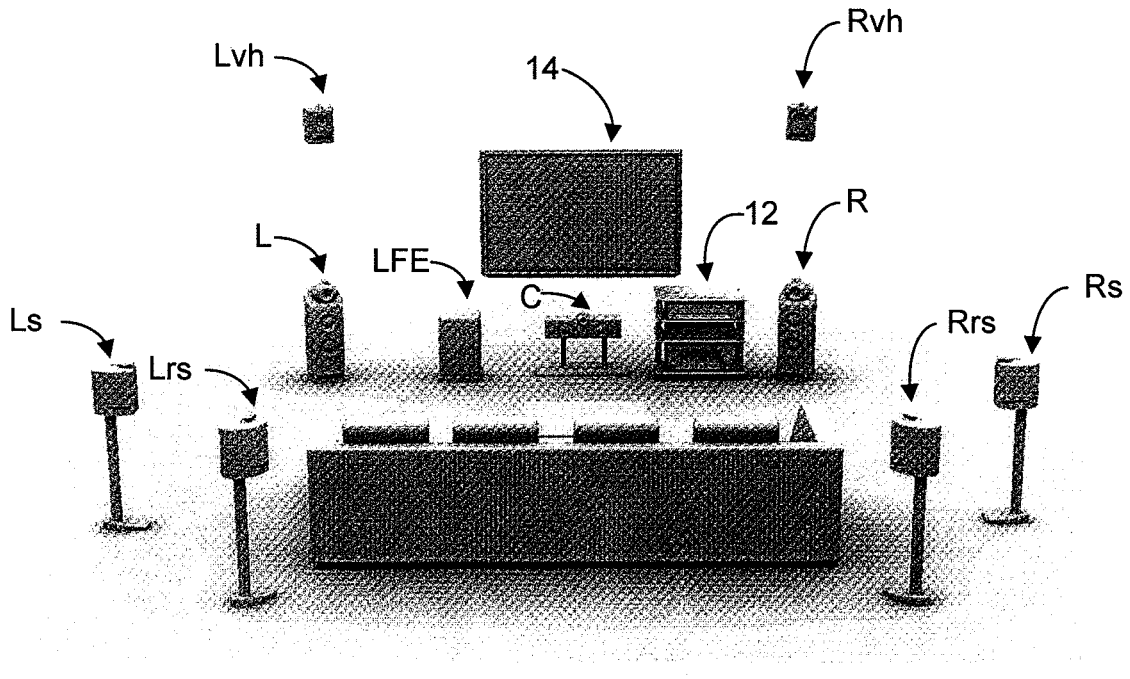
FIG. 6 shows the FIG. 5 example in a small room environment.

FIG. 6 shows the FIG. 5 example in a small room environment. A sofa 10 is located in the listening area 2. Loudspeakers are located at the L, LFE, C, R, Lvh, Rvh, Ls, Rs, Rrs and Lrs loudspeaker locations. Equipment associated with the multiple audio channels are shown schematically at 12. A video screen 13 is located above the center loudspeaker location.

It will be noted that the Lvh and Rvh loudspeaker locations are above the loudspeaker locations of the front audio channels. For example, it has been found that suitable Lvh and Rvh loudspeaker locations are at least one meter above the L and R loudspeaker locations and as high as possible. Also, although it has been found that the Lvh and Rvh loudspeaker locations may be at an angle wider than the L and R loudspeaker locations (up to 45 degrees rather than 30 degrees, for example), the Lvh and Rvh loudspeaker locations preferably are substantially directly above the L and R loudspeaker locations. It will also be noted that the Lvh and Rvh loudspeaker locations are above the Ls, Rs, Lrs and Rrs loudspeaker locations.

FIGS. 7-10 show examples of various ways according to aspects of the present invention in which signals for applying to loudspeakers at the Lvh and Rvh loudspeaker locations may be obtained.

Figure 7:
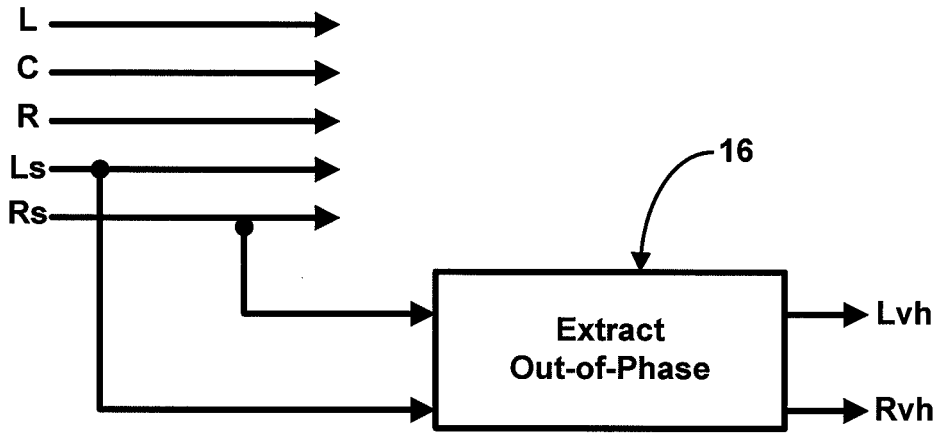

Referring first to FIG. 7, five audio channels (L, C, R, Ls and Rs) for applying to respective loudspeakers at the five loudspeaker locations common to the examples of FIGS. 1, 3 and 4 are shown. Out-of-phase sound information in the pair of channels intended for playback from the loudspeaker locations (Ls, Rs) at the sides of the listening area is extracted by an extractor or extracting process ("Extract Out-of-Phase") 16 to provide signals for application to loudspeakers at the Lvh and Rvh loudspeaker locations (FIGS. 3 and 4). Device or process 16 may be, for example, a passive or active matrix. A suitable passive matrix may be characterized as $$Lvh=[(0.871*Ls)-(0.49*Rs)], \text{ and}$$

$$Rvh=[(-0.49*Ls)+(0.871*Rs)].$$

The quiescent matrix condition of a suitable active matrix may also be characterized in the same manner.

Thus, the extracting device or process 16 extracts two audio signals, a left vertical height signal and a right vertical height signal, for coupling, respectively, to the left vertical height and right vertical height loudspeakers. Each of the vertical height signals comprise out-of-phase components in Ls and Rs channels, the left vertical height signal being weighted to the left side and/or left rear side channel in the pair of channels and the right vertical height signal being weighted to the right side and/or right rear side channel in the pair of channels by virtue of the matrix coefficients (0.871 and 0.49, in the example). Preferably, the vertical height signals are in-phase with respect to one another.

Figure 8:
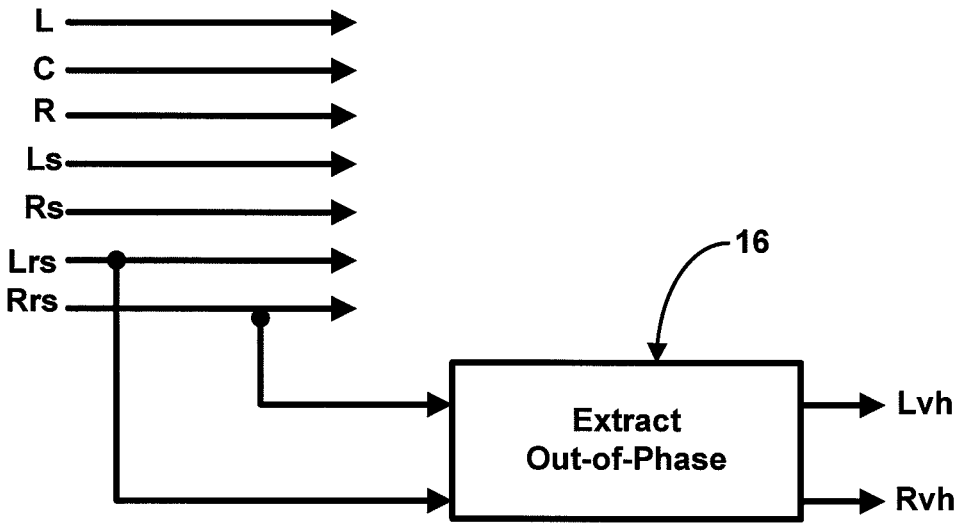

In the example of FIG. 8, seven audio channels (L, C, R, Ls, Rs, Lrs and Rrs) for applying to respective loudspeakers at the seven loudspeaker locations common to the examples of FIGS. 2, 5 and 6 are shown. Out-of-phase sound information in the pair of channels intended for playback from the loudspeaker locations (Ls, Rs) at the sides of the listening area is extracted by an extractor or extracting process ("Extract Out-of-Phase") 16 to provide signals for application to loudspeakers at the Lvh and Rvh loudspeaker locations (FIGS. 5 and 6). Device or process 16 may be, for example, a passive or active matrix. A suitable passive matrix may be characterized as $$Lvh=[(0.871*Lrs)-(0.49*Rrs)], \text{ and}$$

$$Rvh=[(-0.49*Lrs)+(0.871*Rrs)].$$

The quiescent matrix condition of a suitable active matrix may also be characterized in the same manner.

Thus, the extracting device or process 16 extracts two audio signals, a left vertical height signal and a right vertical height signal, for coupling, respectively, to the left vertical height and right vertical height loudspeakers. Each of the vertical height signals comprise out-of-phase components in Ls and Rs channels, the left vertical height signal being weighted to the left side and/or left rear side channel in the pair of channels and the right vertical height signal being weighted to the right side and/or right rear side channel in the pair of channels by virtue of the matrix coefficients (0.871 and 0.49, in the example). Preferably, the vertical height signals are in-phase with respect to one another.

Although it has been found suitable to extract the left vertical height signal and right vertical height signal from the Ls and Rs channel pair, the vertical height signals may also be extracted from the Lrs and Rrs channel pair.

Figure 9:
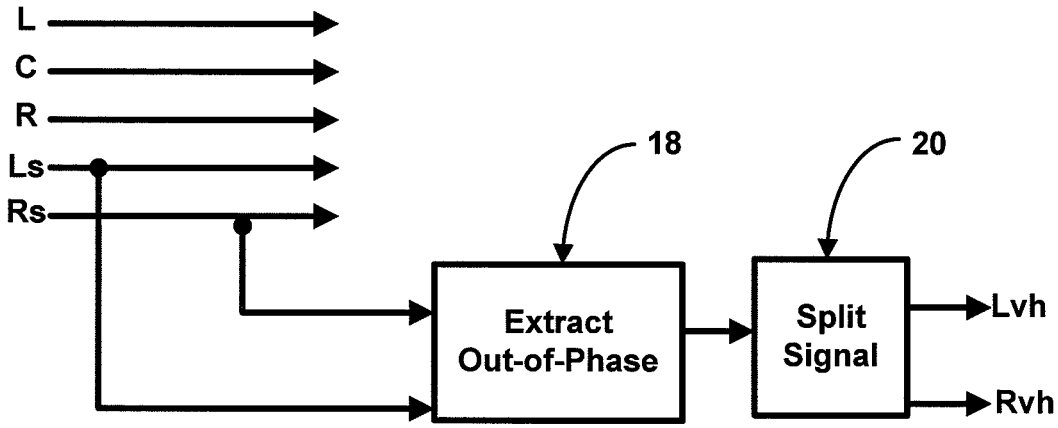

In the example of FIG. 9, five audio channels (L, C, R, Ls and Rs) for applying to respective loudspeakers at the five loudspeaker locations common to the examples of FIGS. 1, 3 and 4 are shown. Out-of-phase sound information in the pair of channels intended for playback from the loudspeaker locations (Ls, Rs) at the sides of the listening area is extracted by an extractor or extracting process ("Extract Out-of-Phase") 18 and a signal splitter or signal splitting process ("Split Signal") 20 to provide signals for application to loudspeakers at the Lvh and Rvh loudspeaker locations (FIGS. 3 and 4). In this example, the extracting device or process derives a single monophonic signal rather than two stereophonic-like signals as in the examples of FIGS. 7 and 8. Device or process 18 may be, for example, a passive or active matrix. A suitable passive matrix may be characterized as $$Lvh=Rvh=(Ls-Rs).$$

The quiescent matrix condition of a suitable active matrix may also be characterized in the same manner. The signal splitting device or process 20 may be considered to be part of the extracting device or process 18.

The single monophonic signal may be split into two copies of the same signal. Alternatively, some type of pseudo-stereo derivation may be applied to the monophonic signal.

Thus, the extracting device or process 18 extracts two audio signals, a left vertical height signal and a right vertical height signal, for coupling, respectively, to the left vertical height and right vertical height loudspeakers. Each of the vertical height signals comprise out-of-phase components in Ls and Rs channels. Preferably, the vertical height signals are in-phase with respect to one another.

Figure 10:
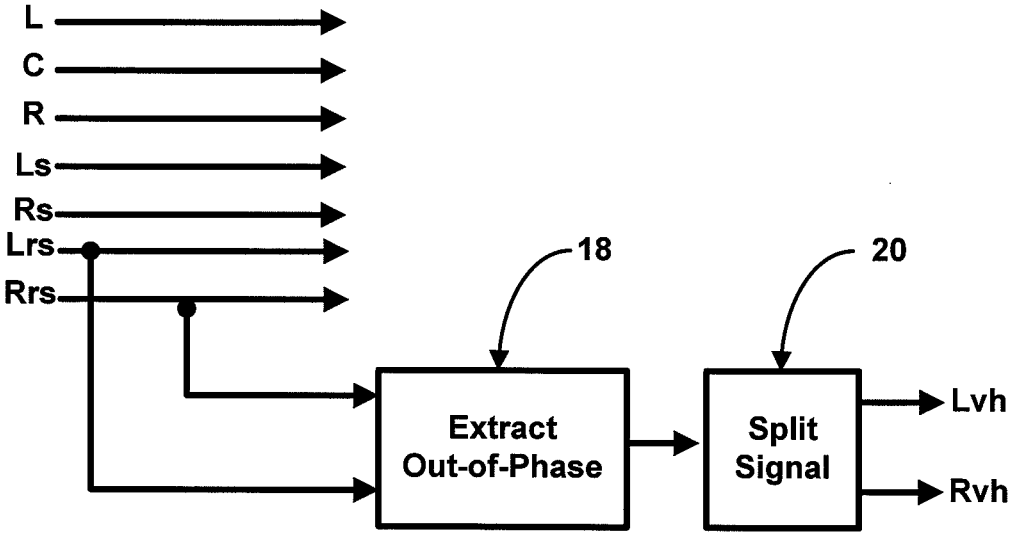

In the example of FIG. 10, seven audio channels (L, C, R, Ls, Rs, Lrs and Rrs) for applying to respective loudspeakers at the seven loudspeaker locations common to the examples of FIGS. 2, 5 and 6 are shown. Out-of-phase sound information in the pair of channels intended for playback from the loudspeaker locations (Ls, Rs) at the sides of the listening area is extracted by an extractor or extracting process ("Extract Out-of-Phase") 18 and a signal splitter or signal splitting process ("Split Signal") 20 to provide signals for application to loudspeakers at the Lvh and Rvh loudspeaker locations (FIGS. 3 and 4). In this example, the extracting device or process derives a single monophonic signal rather than two stereophonic-like signals as in the examples of FIGS. 7 and 8. Device or process 18 may be, for example, a passive or active matrix. A suitable passive matrix may be characterized as $$Lvh=Rvh=(Lrs-Rrs).$$

The quiescent matrix condition of a suitable active matrix may also be characterized in the same manner. The signal splitting device or process 20 may be considered to be part of the extracting device or process 18.

The single monophonic signal may be split into two copies of the same signal. Alternatively, some type of pseudo-stereo derivation may be applied to the monophonic signal.

Thus, the extracting device or process 18 extracts two audio signals, a left vertical height signal and a right vertical height signal, for coupling, respectively, to the left vertical height and right vertical height loudspeakers. Each of the vertical height signals comprise out-of-phase components in Ls and Rs channels. Preferably, the vertical height signals are in-phase with respect to one another.

Although it has been found suitable to extract the left vertical height signal and right vertical height signal from the Ls and Rs channel pair, the vertical height signals may also be extracted from the Lrs and Rrs channel pair.

In the various exemplary embodiments of FIGS. 3-10, the multiple audio channels (L, C, R, Ls, Rs, Lvh, Rvh; L, C, R, Ls, Rs, Lrs, Rrs, Lvh, Rvh) may be audio channels derived from a pair of audio source signals. Such pair of audio signals may be a stereophonic pair of audio signals into which directional information is encoded. A pair of independent signals representing respective channels intended for playback to the sides and/or rear of the listening area may be encoded with out-of-phase vertical height information. In the absence of such encoding, which may be difficult to implement, the vertical height signals obtained may be considered to be pseudo-height signals. It is an aspect of the present invention that, in view of their manner of derivation, such pseudo-height signals are unlikely to include sounds that are non-sensical or out-of-place when reproduced by loudspeakers in the Lvh and Rvh positions. Such pseudo-height signals will comprise mainly ambient or diffuse sounds present in the side or rear side channels.

Alternatively, the multiple audio channels may be derived from more than two audio source signals comprising independent (or discrete) signals representing respective channels intended for playback to the front of the listening area and to the sides and/or rear of the listening area. A pair of independent signals representing respective channels intended for playback to the sides and/or rear of the listening area may be encoded with out-of-phase vertical height information. In that case, sounds may be explicitly located for playback by loudspeakers at the Lvh and Rvh loudspeaker locations.

For simplicity the various figures do not show relative time delays and gain adjustments as may be necessary in implementing a practical sound reproduction arrangement. The manner of implementing such time delays and gain adjustments are well known in the art and do not form a part of the present invention.

It will be understood that the arrangements of FIGS. 1-6 for reproducing multiple audio channels are examples of environments for aspects of the present invention. For example, the angular locations of the loudspeaker locations in the FIG. 1 and FIG. 2 examples are not critical to the invention. Also, it should also be understood that more than one loudspeaker may be placed at or in proximity to a loudspeaker location.

Implementation

The invention may be implemented in hardware or software, or a combination of both (e.g., programmable logic arrays). Unless otherwise specified, the algorithms included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. For example, some of the steps described herein may be order independent, and thus can be performed in an order different from that described.

What is claimed is:

1. An out-of-phase sound extractor circuit comprising:

an interface receiving audio signals from respective loudspeakers placed in a defined surround sound layout comprising a left loudspeaker floor-mounted along a front wall in front of a listening area and projecting from a left portion of the front wall to a listening area center, a right loudspeaker floor-mounted along the front wall in front of the listening area and projecting from a right portion of the front wall to the listening area center, a left vertical height loudspeaker mounted proximate the front wall at least one meter directly above the left loudspeaker, and a right vertical height loudspeaker mounted proximate the front wall at least one meter directly above the right loudspeaker; and a passive matrix data structure generating a quiescent matrix condition by extracting two audio signals comprising a left vertical height signal and a right vertical height signal for coupling, respectively, to the left vertical height and right vertical height loudspeakers.

2. The circuit of claim 1 wherein a video screen is positioned on the front wall and the left portion of the wall is to the left of the video screen and the right portion of the wall is to the right of the video screen; and further wherein each of the left vertical and right vertical height signals comprises out-of-phase components designated respectfully as Ls and Rs channels, the left vertical height signal (Lvh) being weighted to the left side or left rear side channel in the channels, and the right vertical height signal (Rvh) being weighted to the right side or right rear side channel in the channels by virtue of defined matrix coefficients.

3. The circuit of claim 2 wherein the left vertical and right vertical height signals are in-phase with respect to one another.

4. The circuit of claim 1 wherein the extractor circuit outputs a single monophonic signal to a splitter that creates the left vertical height signal and right vertical height signal, and further wherein the passive matrix data structure is characterized as $$Lvh=Rvh=(Ls-Rs).$$

5. The circuit of claim 2 wherein the defined matrix coefficients comprise two coefficients wherein one coefficient is on the order of between 0.5 and 1, and a second coefficient is on the order of 0.5.

6. The circuit of claim 5 wherein the passive matrix data structure is characterized as:

$$Lvh=[(0.871*Ls)-(0.49*Rs)], \text{ and}$$

$$Rvh=[(-0.49*Ls)+(0.871*Rs)].$$

7. The circuit of claim 1 wherein the defined surround sound layout comprises seven audio channels designated as: L, C, R, Ls, Rs, Lrs and Rrs.

8. The circuit of claim 7 wherein the extractor circuit is embodied in a programmable logic array device for use in an audio system.

9. The circuit of claim 8 wherein the passive matrix data structure comprises a programmed transfer function applied to the received audio signals to produce audio speaker feeds to transmission to the respective loudspeakers.

10. The circuit of claim 8 wherein the audio system is configured to decode audio content comprising height cues encoded in one or more of the audio channels for playback through height speakers receiving the Lvh and Rvh signals.

11. A method of extracting out-of-phase sound, comprising:

receiving, through an audio interface, audio signals from respective loudspeakers placed in a defined surround sound layout comprising a left loudspeaker floor-mounted along a front wall in front of a listening area and projecting from a left portion the front wall to a listening area center, a right loudspeaker floor-mounted along the front wall in front of the listening area and projecting from a right portion of the front wall to the listening area center, a left vertical height loudspeaker mounted proximate the front wall at least one meter directly above the left loudspeaker, and a right vertical height loudspeaker mounted proximate the front wall at least one meter directly above the right loudspeaker; and defining a passive matrix data structure generating a quiescent matrix condition by extracting two audio signals comprising a left vertical height signal and a right vertical height signal for coupling, respectively, to the left vertical height and right vertical height loudspeakers.

12. The method of claim 11 wherein a video screen is positioned on the front wall and the left portion of the wall is to the left of the video screen and the right portion of the wall is to the right of the video screen; and further wherein each of the left vertical and right vertical height signals comprises out-of-phase components designated respectfully as Ls and Rs channels, the left vertical height signal (Lvh) being weighted to the left side or left rear side channel in the channels, and the right vertical height signal (Rvh) being weighted to the right side or right rear side channel in the channels by virtue of defined matrix coefficients.

13. The method of claim 2 wherein the left vertical and right vertical height signals are in-phase with respect to one another.

14. The method of claim 13 further comprising outputting a single monophonic signal to a splitter that creates the left vertical height signal and right vertical height signal, and wherein the passive matrix data structure is characterized as $$Lvh=Rvh=(Ls-Rs).$$

15. The method of claim 12 wherein the defined matrix coefficients comprise two coefficients wherein one coefficient is on the order of between 0.5 and 1, and a second coefficient is on the order of 0.5.

16. The method of claim 15 wherein the passive matrix data structure is characterized as:

$$Lvh=[(0.871*Ls)-(0.49*Rs)], \text{ and}$$

$$Rvh=[(-0.49*Ls)+(0.871*Rs)].$$

17. The method of claim 11 wherein the defined surround sound layout comprises seven audio channels designated as: L, C, R, Ls, Rs, Lrs and Rrs, and wherein the extractor circuit is embodied in a programmable logic array device for use in an audio system.

18. The method of claim 17 wherein the passive matrix data structure comprises a programmed transfer function applied to the received audio signals to produce audio speaker feeds to transmission to the respective loudspeakers.

19. The method of claim 18 wherein the audio system is configured to decode audio content comprising height cues encoded in one or more of the audio channels for playback through height speakers receiving the Lvh and Rvh signals.

20. A computer program adapted to implement the method of claim 11.

* * * * *